US008994631B2

(12) United States Patent
Chun et al.

(10) Patent No.: US 8,994,631 B2
(45) Date of Patent: Mar. 31, 2015

(54) LIQUID CRYSTAL DISPLAY DEVICE AND METHOD FOR DRIVING THE SAME

(75) Inventors: Min Doo Chun, Seoul (KR); Nam Wook Cho, Gyeonggi-do (KR); Soo Young Yoon, Gyeonggi-do (KR); Seung Chan Choi, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1658 days.

(21) Appl. No.: 11/646,271

(22) Filed: Dec. 28, 2006

(65) Prior Publication Data

US 2008/0001889 A1 Jan. 3, 2008

(30) Foreign Application Priority Data

Jun. 30, 2006 (KR) ..... 10-2006-061462

(51) Int. Cl.
*G09G 3/36* (2006.01)
*G09G 3/20* (2006.01)

(52) U.S. Cl.
CPC ..... *G09G 3/3614* (2013.01); *G09G 3/2011* (2013.01); *G09G 2320/0247* (2013.01)
USPC ..... 345/96; 345/89

(58) Field of Classification Search
USPC ..... 345/96, 89
See application file for complete search history.

(56) References Cited

U.S. PATENT DOCUMENTS 6,075,505 A 6/2000 Shiba et al.
2002/0084960 A1 7/2002 Song et al.
2005/0231455 A1* 10/2005 Moon ..... 345/89
2005/0275611 A1* 12/2005 Aoki ..... 345/96
2006/0007093 A1* 1/2006 La ..... 345/96

FOREIGN PATENT DOCUMENTS

CN 1628260 A 6/2005
KR 10-1998-0019206 A 6/1998
KR 10-2003-0091303 A 12/2003
WO WO 03/091790 A1 11/2003
WO WO 03/100508 * 12/2003 ..... G02F 1/133

OTHER PUBLICATIONS

Korean Office Action—Korean Patent Application No. 10-2006-0061462—Issued on Aug. 2, 2012.

* cited by examiner

*Primary Examiner* — Amare Mengistu
*Assistant Examiner* — Joseph G Rodriguez
(74) *Attorney, Agent, or Firm* — Morgan, Lewis & Bockius LLP

(57) ABSTRACT

An LCD device includes at least one data line, a plurality of first pixel cells connected in common to one side of the data line, a timing controller for alternately outputting first and second-polarity data signals at intervals of at least two successive periods, a data modulator for outputting the first and second-polarity data signals supplied from the timing controller, the data modulator modulating a grayscale value of one of the first and second-polarity data signals respectively supplied in two successive periods from the timing controller, and outputting the modulated data signal, and a data driver for receiving the first and second-polarity data signals from the data modulator, and alternately outputting the first and second-polarity data signals at intervals of at least two successive periods, to supply the first and second-polarity data signals to the data line.

6 Claims, 9 Drawing Sheets

| | | | | | |
|---|---|---|---|---|---|
| + | - | + | - | + | - |
| + | - | + | - | + | - |
| - | + | - | + | - | + |
| - | + | - | + | - | + |
| + | - | + | - | + | - |
| + | - | + | - | + | - |

Fn

| | | | | | |
|---|---|---|---|---|---|
| - | + | - | + | - | + |
| - | + | - | + | - | + |
| + | - | + | - | + | - |
| + | - | + | - | + | - |
| - | + | - | + | - | + |
| - | + | - | + | - | + |

Fn+1

LIQUID CRYSTAL DISPLAY DEVICE AND METHOD FOR DRIVING THE SAME

This application claims the benefit of the Korean Patent Application No. P2006-0061462, filed on Jun. 30, 2006, which is hereby incorporated by reference.

BACKGROUND OF THE INVENTION

1. Field of the Invention

The present invention relates to a liquid crystal display (LCD) device, and more particularly, to an LCD device that can reduce the brightness deviation among pixel cells in a 2-dot inversion system and a method for driving the same.

2. Discussion of the Related Art

Typically, liquid crystal display (LCD) devices display an image by controlling light transmittances of liquid crystal cells. In particular, in an active matrix LCD device, there is an advantage in displaying video images because switching devices are provided for respective liquid crystal cells. For such switching devices, thin film transistors (TFTs) are mainly used.

LCD devices are driven in an inversion mode. The polarity of data charged in each liquid crystal cell is periodically inverted to achieve a reduction in flickers and latent images. There are various inversion methods. For example, in a line inversion method, polarity inversion of data is carried out between liquid crystal cells arranged adjacent to each other in a vertical line direction. In a column inversion method, polarity inversion of data is carried out between liquid crystal cells arranged adjacent to each other in a horizontal line direction. In a dot inversion method, polarity inversion of data is carried out between liquid crystal cells arranged adjacent to each other in both the vertical line direction and the horizontal line direction.

In the dot inversion method, the polarities of data signals respectively supplied to the vertically-adjacent pixel cells are opposite to each other, and the polarities of data signals respectively supplied to the horizontally-adjacent pixel cells are also opposite to each other. In this method, the polarity of each data signal is inverted at intervals of one frame period. In the dot inversion method, generation of flickers is minimized in both the vertical and horizontal directions. Accordingly, this method is applied to most LCD devices commercially available as monitors or televisions. However, the dot inversion method has a drawback. The power consumption is high because the polarity of each data signal should be inverted at intervals of one horizontal period. This problem can be solved by performing driving of a liquid crystal panel in a 2-dot inversion mode.

FIG. 1 is a schematic view showing the 2-dot inversion mode. In the 2-dot inversion method, as shown in FIG. 1, data signals respectively supplied to the pixel cells arranged in a horizontal direction have opposite polarities at intervals of one pixel cell, respectively. On the other hand, data signals respectively supplied to the pixel cells arranged in a vertical direction have opposite polarities at intervals of two pixel cells, respectively. In this method, the polarity of each data signal is inverted at intervals of one frame. For example, the polarity of each data signal is inverted between successive frames Fn and Fn+1, as shown in FIG. 1.

However, the above-mentioned 2-dot inversion method has the following problems. FIG. 2 is a waveform diagram showing problems incurred in the 2-dot inversion method. In order to drive an LCD device in a 2-dot inversion mode, a data signal that exhibits a polarity variation, as shown in FIG. 2, is supplied to a data line. A positive data signal Vdata is supplied to the data line in first and second periods T1 and T2, whereas a negative data signal Vdata is supplied to the data line in third and fourth periods T3 and T4. Also, a positive data signal Vdata is supplied to the data line in fifth and sixth periods T5 and T6.

In this case, the charging of the data line for a duration from the first period T1 to the second period T2 is carried out rapidly because the data signal Vdata supplied to the data line in the first period T1 and the data signal Vdata supplied to the data line in the second period T2 both have a positive polarity. However, the charging of the data line for a duration from the second period T2 to the third period T3 is carried out slowly because the polarity of the data signal Vdata transits from a positive polarity to a negative polarity in the third period T3.

Although there is no problem associated with charging speed when the polarity of the data signal Vdata charged in each data line is not changed, when a transition occurs, there is a reduction in the charging speed because the polarity of the data signal Vdata charged in each data line changes. For example, the polarity changes from a positive state to a negative state, or from a negative state to a positive state when a transition occurs. As a result, there can be a deviation of brightness between pixel cells which are connected to the same data line, but receive data signals Vdata of different polarities.

SUMMARY OF THE INVENTION

Accordingly, the present invention is directed to a liquid crystal display device and a method for driving the same that substantially obviate one or more problems due to limitations and disadvantages of the related art.

An object of the present invention is to provide a liquid crystal display device that is capable of achieving a desired compensation for a brightness deviation by modulating one of the data signals of different polarities such that the modulated data signal has a grayscale value higher than an original grayscale value and a method for driving the same.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the liquid crystal display device includes at least one data line, a plurality of first pixel cells connected in common to one side of the data line, and sequentially driven in accordance with gate signals respectively output from first gate lines in every period, a timing controller for alternately outputting first and second-polarity data signals at intervals of at least two successive periods, a data modulator for outputting the first and second-polarity data signals supplied from the timing controller, the data modulator modulating a grayscale value of one of the first and second-polarity data signals respectively supplied in two successive periods from the timing controller, and outputting the modulated data signal, and a data driver for receiving the first and second-polarity data signals from the data modulator, and alternately outputting the first and second-polarity data signals at intervals of at least two successive periods, to supply the first and second-polarity data signals to the data line.

In another aspect, the method for driving a liquid crystal display device includes modulating a grayscale value of one of the first and second-polarity data signals respectively supplied in two successive periods from the timing controller, for all the first and second-polarity data signals supplied from the time controller, and alternately outputting the resultant first and second-polarity data signals at intervals of at least two successive periods, to supply the first and second-polarity data signals to the data line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figures 1, 2:
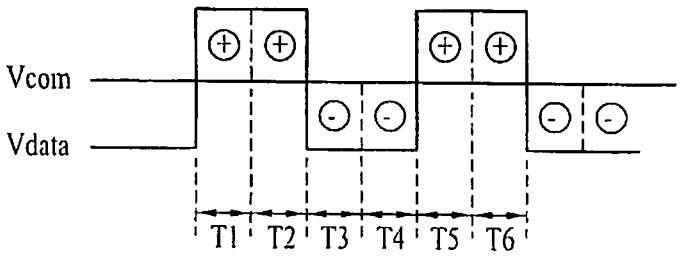
FIG. 1 Related Art
FIG. 2 Related Art
FIG. 1 is a schematic view showing the 2-dot inversion mode.
FIG. 2 is a waveform diagram showing problems incurred in the 2-dot inversion method.
Figure 3:
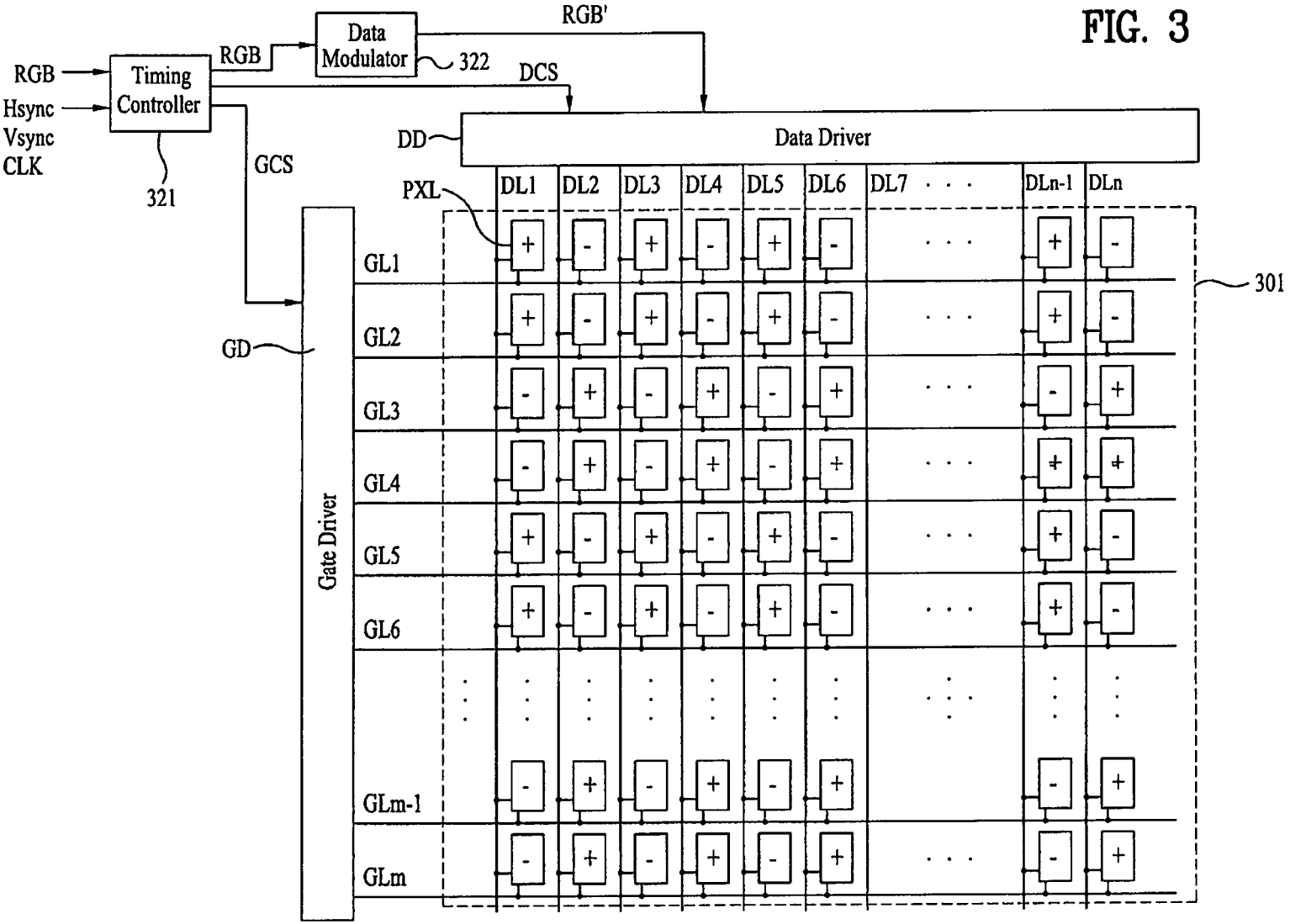
FIG. 3 is a block diagram illustrating a liquid crystal display (LCD) device according to a first exemplary embodiment of the present invention.
Figure 4:
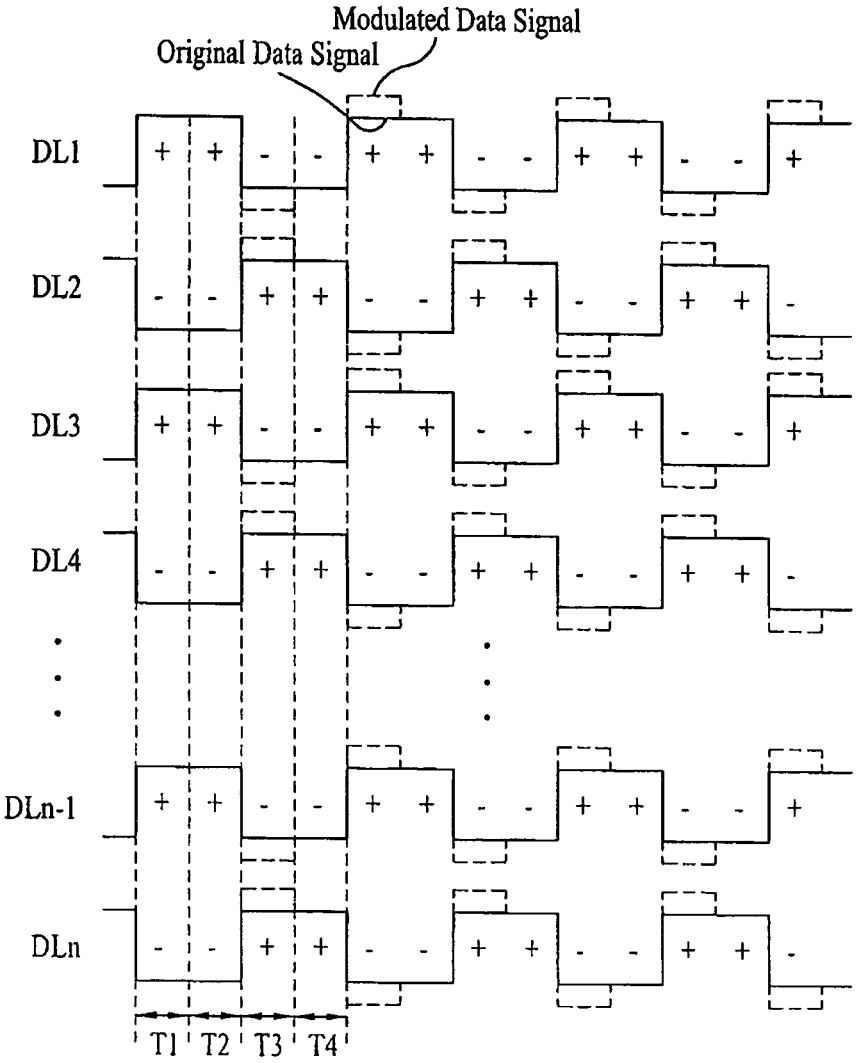
FIG. 4 is a timing diagram of a data signal output from a data driver shown in FIG. 3 according to the present invention.

FIG. 3 is a block diagram illustrating a liquid crystal display (LCD) device according to a first exemplary embodiment of the present invention. FIG. 4 is a timing diagram of a data signal output from a data driver shown in FIG. 3 according to the present invention. As shown in FIG. 3, the LCD device according to the first exemplary embodiment of the present invention includes a liquid crystal panel 301 including a plurality of gate lines GL1 to GLm and a plurality of data lines DL1 to DLn, which intersect each other. The LCD device further includes a gate driver GD for driving the gate lines GL1 to GLm and a data driver DD for driving the data lines DL1 to DLn, a timing controller 321 for controlling the gate driver GD and data driver DD, and a data modulator 322 for modulating data signals supplied from the timing controller 321. The data modulator 322 further supplies the modulated data signals to the data driver DD.

A matrix of pixel cells PXL are formed in pixel regions by intersecting gate lines GL1 to GLm and data lines DL1 to DLn. Each pixel cell PXL is connected to the data line arranged at the left side thereof and is connected to the gate line arranged therebeneath. Although not shown, each pixel cell PXL includes a TFT, a pixel electrode, and a common electrode. The TFT supplies a data signal from the data line to the pixel electrode in response to a scan pulse from the gate line. A liquid crystal layer is formed between the pixel electrode and the common electrode. The pixel electrode adjusts the light transmittance of the liquid crystal layer using an electric field generated by the voltage difference between the pixel electrode and the common electrode. A voltage according to the data signal is applied to the pixel electrode and a common voltage is applied to the common electrode.

Each pixel cell PXL further includes an auxiliary capacitor. The auxiliary capacitor functions to sustain the data signal supplied to the pixel electrode until a next data signal is supplied.

The timing controller 321 supplies a video data signal RGB supplied from a system (not shown) to the data driver DD via the data modulator 322. The timing controller 321 also generates a gate control signal GCS for controlling the gate driver GD and a data control signal DCS for controlling the data driver DD using a vertical synchronizing signal Vsync, a horizontal synchronizing signal Hsync, and a clock signal CLK.

The data control signal DCS includes a source start pulse, a source shift clock, a source output enable signal, and a polarity control signal. The polarity control signal designates the polarity of the video data signal RGB. The gate control signal GCS includes a gate shift clock, a gate output enable signal, and a gate start pulse.

The video data signal RGB includes a positive data signal and a negative data signal. The positive data signal is a data signal having a voltage higher than the common voltage, whereas the negative data signal is a data signal having a voltage lower than the common voltage.

The timing controller 321 alternately outputs the positive and negative data signals, to be supplied to each of the data lines DL1 to DLn, at intervals of at least two successive periods. For example, the timing controller 321 outputs the positive data signal in each of the successive first and second periods. Then, the timing controller 321 outputs the negative data signal in each of the successive third and fourth periods.

The data modulator 322 sequentially receives the positive and negative data signals from the timing controller 321 in the output order of those signals. The data modulator 322 receives the data signals (positive and negative data signals) associated with one frame period. In other words, the data modulator 322 receives the data signals to be supplied to all pixels PXL of FIG. 3. The data modulator 322 modulates the grayscale value of one of the positive and negative data signals to be output to one data line in one of the two successive periods, respectively. In other words, the data modulator 322 modulates the voltage of the original data signal. In particular, the data modulator 322 maintains the grayscale value of the data signal to be first supplied to one data line in the successive periods and modulates the grayscale value of the data signal to be subsequently supplied to the data line in the successive periods.

For example, assuming that the data signal to be first supplied to the first data line DL1 has a positive polarity, and the data signal to be subsequently supplied to the first data line DL1 has a negative polarity, the data modulator 322 modulates the grayscale value of the negative data signal. In this case, the data modulator 322 modulates the negative data signal such that it has a grayscale value higher than (or lower than) the original grayscale value thereof. In particular, the data modulator 322 modulates the grayscale value to a level higher than (or lower than) the original grayscale value by 1 to 10 levels.

The LCD device may be driven in a normally white mode or in a normally black mode. In the normally white mode, the LCD device displays the brightest light, i.e., white, in response to a data signal having a minimum grayscale value and displays the darkest light, i.e., black, in response to a data signal having a maximum grayscale value. In the normally black mode, the LCD device displays the brightest light, i.e., white, in response to a data signal having a maximum grayscale value and displays the darkest light, i.e., black, in response to a data signal having a minimum grayscale value.

Where the LCD device is driven in the normally white mode, the data modulator 322 modulates the negative data signal such that it has a grayscale value higher than the original grayscale value thereof (an absolute grayscale value). Where the LCD device is driven in the normally black mode, the data modulator 322 modulates the negative data signal such that it has a grayscale value lower than the original grayscale value thereof (an absolute grayscale value).

The data modulator 322 re-arranges the modulated data signal and the remaining positive and negative data signals, and then supplies the re-arranged data signals to the data driver DD. The data driver DD receives the positive and negative data signals (including the modulated data signal) from the data modulator 322 and alternately outputs the positive and negative data signals at intervals of at least two successive periods. Then, the data driver DD supplies the positive and negative data signals to the data lines DL1 to DLn in every horizontal period. In this case, the data driver DD supplies data signals associated with the pixel cells PXL arranged on one horizontal line to the data lines DL1 to DLn in every horizontal period, respectively.

The data driver DD supplies data signals of different polarities to the adjacent data lines, respectively. As shown in FIG. 4, the data driver DD supplies data signals of different polarities to the odd data lines DL1, DL3, . . . , DLn−1 and the even data lines DL2, DL4, . . . , DLn, respectively. The data driver DD alternately outputs the positive and negative data signals to the odd data lines DL1, DL3, . . . , DLn−1 at intervals of at least two periods, respectively. The positive data signal is supplied earlier than the negative data signal in the odd data lines. Also, the data driver DD alternately outputs the positive and negative data signals to the even data lines DL2, DL4, . . . , DLn at intervals of at least two periods, respectively. The negative data signal is supplied earlier than the positive data signal in the even data lines. Accordingly, data signals of different polarities are supplied to the odd data lines DL1, DL3, . . . , DLn−1 and the even data lines DL2, DL4, . . . , DLn, respectively, in the same period.

Figure 5:
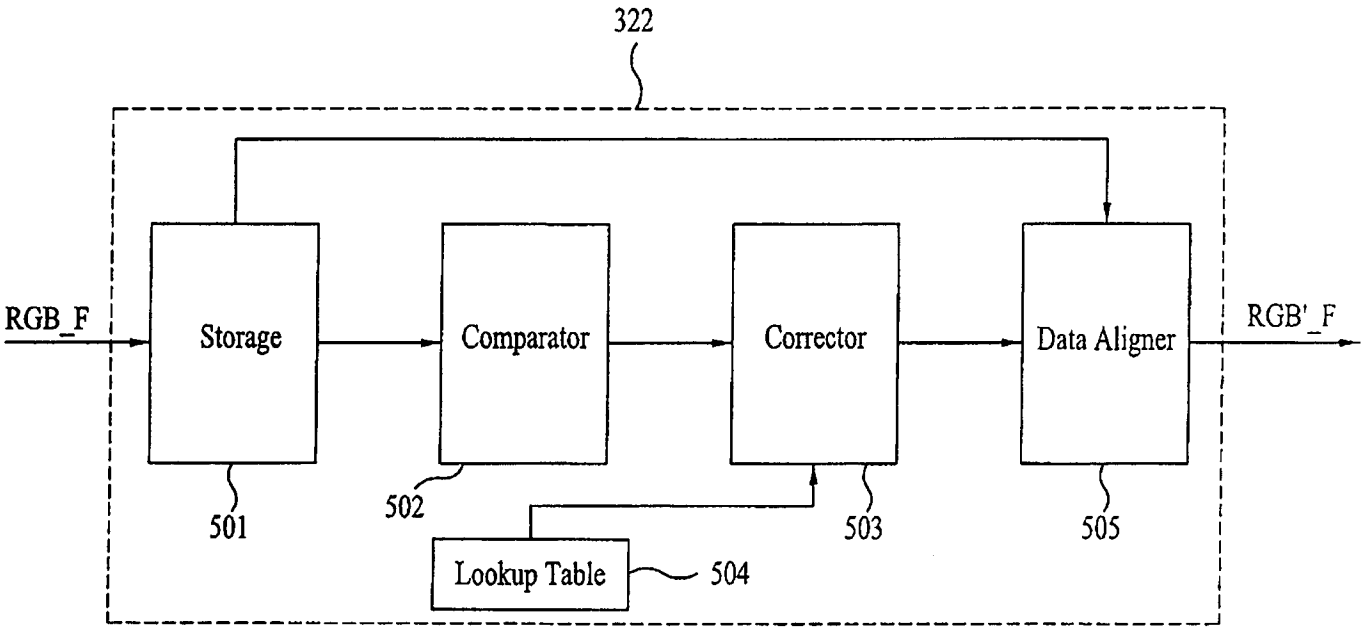
FIG. 5 is a first exemplary block diagram of a data modulator shown in FIG. 3 according to the present invention.

FIG. 5 is a first exemplary block diagram of a data modulator shown in FIG. 3 according to the present invention. As shown in FIG. 5, the data modulator 322 includes a storage 501 for receiving a plurality of positive and negative data signals associated with one frame period from the timing controller 321 and storing the received positive and negative data signals. The data modulator 322 further includes a comparator 502 for comparing the grayscale values of the positive and negative data signals respectively supplied to the storage 501 in two successive periods, for all the positive and negative data signals, to determine a grayscale value difference between the compared data signals. The data modulator 322 further includes a lookup table 504 stored with various correction grayscale values respectively corresponding to various grayscale differences. The data modulator 322 further includes a corrector 503 for selecting a desired grayscale value from the lookup table 504, based on the result of the comparison from the comparator 502, and correcting the grayscale value of one of the positive and negative data signals supplied in the two successive periods. The data modulator 322 further includes a data aligner 505 for aligning the corrected data signal from the corrector 503 with the positive and negative data signals from the storage 501 and alternately outputting the aligned positive and negative data signals at intervals of at least two successive periods.

For all positive and negative data signals supplied to the storage 501, the comparator 502 calculates the difference between the grayscale values of the positive and negative data signals respectively output in two successive periods, and supplies the calculated value to the corrector 503. The lookup table 504 is stored with a plurality of different correction grayscale values predetermined in accordance with various grayscale value differences of positive and negative data signals. The corrector 503 reads one correction grayscale value from the lookup table 504, based on the calculated value from the comparator 502, and corrects the grayscale value of the compared positive or negative data signals to a desired value according to the correction grayscale value that is read from the lookup table 504. For example, where the data signal to be first supplied to the first data line DL1 is a positive data signal, and the data signal to be subsequently supplied to the first data line DL1 is a negative data signal, the corrector 503 corrects the original grayscale value of the negative data signal to the correction grayscale value.

The data aligner 505 aligns, i.e., re-arranges, the corrected data signal from the corrector 503 and the data signals from the storage 501. Thereafter, the data aligner 505 alternately outputs the aligned positive and negative data signals to the data driver DD at intervals of at least two periods.

The data driver DD converts the data signals supplied from the data aligner 505 in the form of analog signals. Then, the data driver DD supplies the converted data signals to the data lines DL1 to DLn of the liquid crystal panel 301, respectively. The data driver DD alternately outputs positive and negative data signals at intervals of two successive periods to supply the positive and negative data signals to the data lines DL1 to DLn. Thus, the video data signals RGB_F (the positive and negative signals as described above) of one frame output from the timing controller 321 is modulated to video data signals RGB'_F having corrected grayscale values by the data modulator 322.

Hereinafter, the operation of the data driver DD for outputting the positive and negative data signals will be described in detail. FIGS. 6A to 6E are diagrams illustrating the operation of a data driver according to the exemplary embodiment of the present invention. First, the operation in a first period T1 will be described.

Figure 6A:
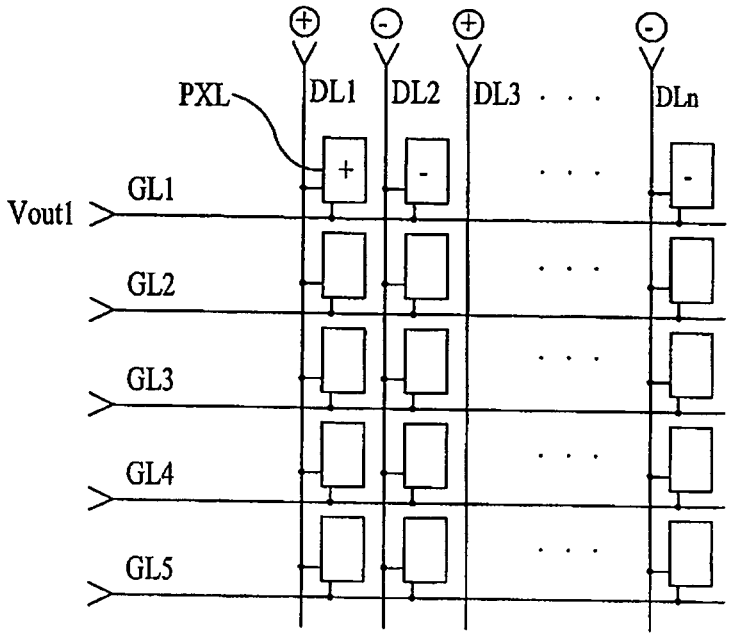
FIGS. 6A to 6E are diagrams illustrating the operation of a data driver according to the exemplary embodiment of the present invention.

In the first period T1, as shown in FIG. 6A, the gate driver GD supplies a first scan pulse Vout1 to the first gate line GL1, to drive the first gate line GL1. As a result, all the TFTs of the pixel cells PXL connected to the first gate line GL1 are turned on. In the first period T1, the data driver DD supplies a positive data signal to the odd data lines DL1, DL3, . . . , DLn−1, and supplies a negative data signal to the even data lines DL2, DL4, . . . , DLn. Accordingly, the odd numbered pixel cells PXL connected to the first gate line GL1 receive positive data signals from the odd data lines DL1, DL3, . . . , DLn−1, respectively, and thus, display positive images, respectively. Also, the even numbered pixel cells PXL connected to the first gate line GL1 receive negative data signals from the even data lines DL2, DL4, . . . , DLn, respectively, and thus, display negative images, respectively.

Figure 6B:
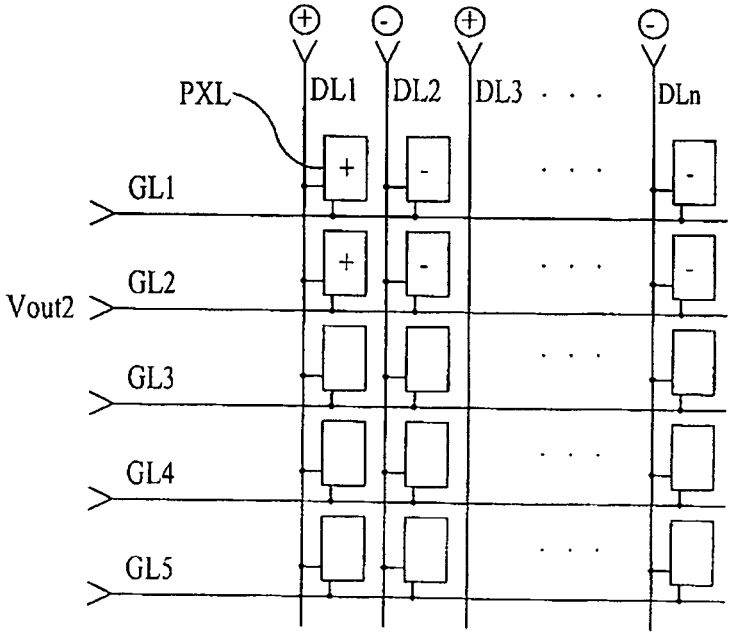

Next, the operation in a second period T2 will be described. In the second period T2, as shown in FIG. 6B, the gate driver GD supplies a second scan pulse Vout2 to the second gate line GL2, to drive the second gate line GL2. As a result, all the TFTs of the pixel cells PXL connected to the second gate line GL2 are turned on. In the second period T2, the data driver DD supplies a positive data signal to the odd data lines DL1, DL3, . . . , DLn−1, and supplies a negative data signal to the even data lines DL2, DL4, . . . , DLn. Accordingly, the odd numbered pixel cells PXL connected to the second gate line GL2 receive positive data signals from the odd data lines DL1, DL3, . . . , DLn−1, respectively, and thus, display positive images, respectively. Also, the even numbered pixel cells PXL connected to the second gate line GL2 receive negative data signals from the even data lines DL2, DL4, . . . , DLn, respectively, and thus, display negative images, respectively.

Figure 6C:
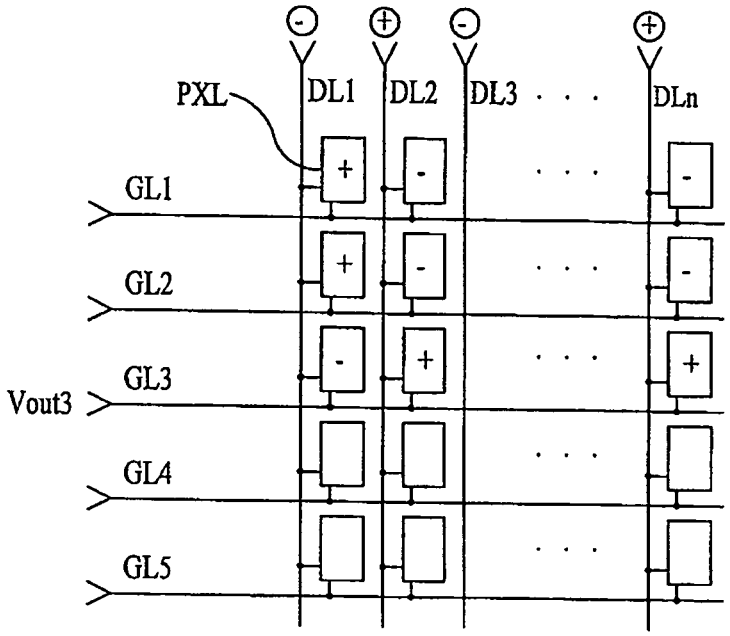

The operation in a third period T3 will now be described. In the third period T3, as shown in FIG. 6C, the gate driver GD supplies a third scan pulse Vout3 to the third gate line GL3, to drive the third gate line GL3. As a result, all the TFTs of the pixel cells PXL connected to the third gate line GL3 are turned on. In the third period T3, the data driver DD supplies a negative data signal to the odd data lines DL1, DL3, . . . , DLn−1, and supplies a positive data signal to the even data lines DL2, DL4, . . . , DLn. Accordingly, each of the odd data lines DL1, DL3, . . . , DLn−1, which has been charged with the positive data signal, is charged with the negative data signal. On the other hand, each of the even data lines DL2, DL4, . . . , DLn, which has been charged with the negative data signal, is charged with the positive data signal. The negative data signal supplied to each of the odd data lines DL1, DL3, . . . , DLn−1 in the third period T3 has a grayscale value higher than that of an original data signal thereof. The positive data signal supplied to each of the even data lines DL2, DL4, . . . , DLn in the third period T3 has a grayscale value higher than that of an original data signal thereof. Accordingly, the pixel cells PXL connected to the third gate line GL3 display images according to data signals each have a grayscale value higher than that of an original data signal thereof, respectively.

Figure 6D:
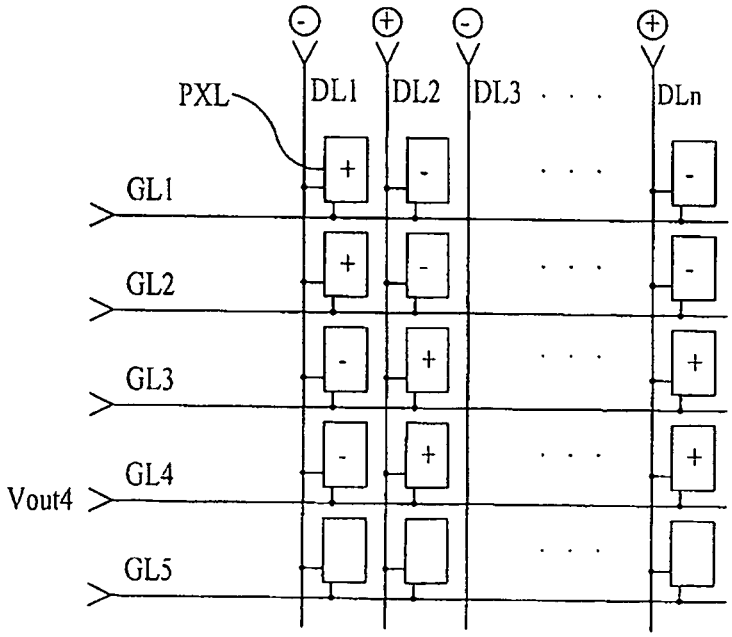

Next, the operation in a fourth period T4 will be described. In the fourth period T4, as shown in FIG. 6D, the gate driver GD supplies a fourth scan pulse Vout4 to the fourth gate line GL4, to drive the fourth gate line GL4. As a result, all the TFTs of the pixel cells PXL connected to the fourth gate line GL4 are turned on. In the fourth period T4, the data driver DD supplies a negative data signal to the odd data lines DL1, DL3, . . . , DLn−1, and supplies a positive data signal to the even data lines DL2, DL4, . . . , DLn. Accordingly, the odd numbered pixel cells PXL connected to the fourth gate line GL4 receive negative data signals from the odd data lines DL1, DL3, . . . , DLn−1, respectively, and thus, display negative images, respectively. Also, the even numbered pixel cells PXL connected to the fourth gate line GL4 receive positive data signals from the even data lines DL2, DL4, . . . , DLn, respectively, and thus, display positive images, respectively.

Figure 6E:
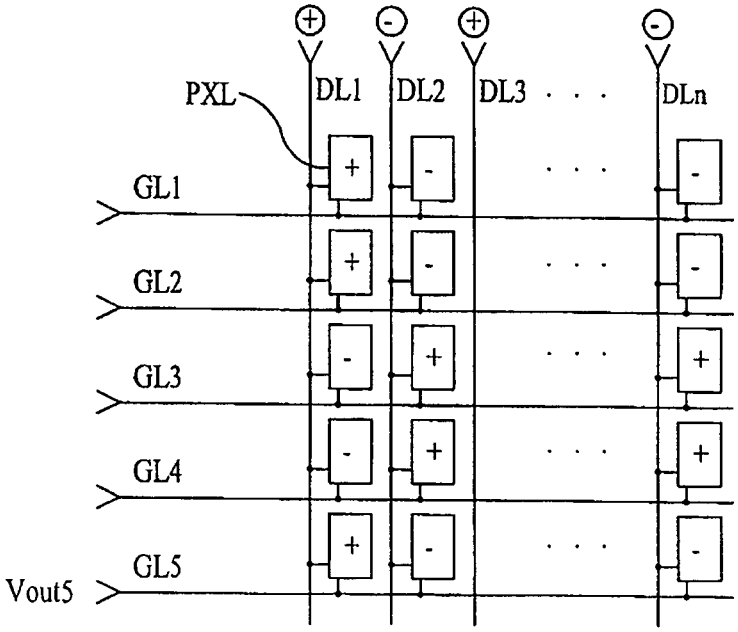

The operation in a fifth period T5 will now be described. In the fifth period T5, as shown in FIG. 6E, the gate driver GD supplies a fifth scan pulse Vout5 to the fifth gate line GL5, to drive the fifth gate line GL5. As a result, all the TFTs of the pixel cells PXL connected to the fifth gate line GL5 are turned on. In the fifth period T5, the data driver DD supplies a positive data signal to the odd data lines DL1, DL3, . . . , DLn−1, and supplies a negative data signal to the even data lines DL2, DL4, . . . , DLn. Accordingly, each of the odd data lines DL1, DL3, . . . , DLn−1, which has been charged with the negative data signal, is charged with the positive data signal. On the other hand, each of the even data lines DL2, DL4, . . . , DLn, which has been charged with the positive data signal, is charged with the negative data signal. The positive data signal supplied to each of the odd data lines DL1, DL3, . . . , DLn−1 in the fifth period T5 has a grayscale value higher than that of an original data signal thereof. The negative data signal supplied to each of the even data lines DL2, DL4, . . . , DLn in the fifth period T5 has a grayscale value higher than that of an original data signal thereof. Accordingly, the pixel cells PXL connected to the fifth gate line GL5 display images according to data signals each having a grayscale value higher than that of an original data signal thereof, respectively.

Figure 7:
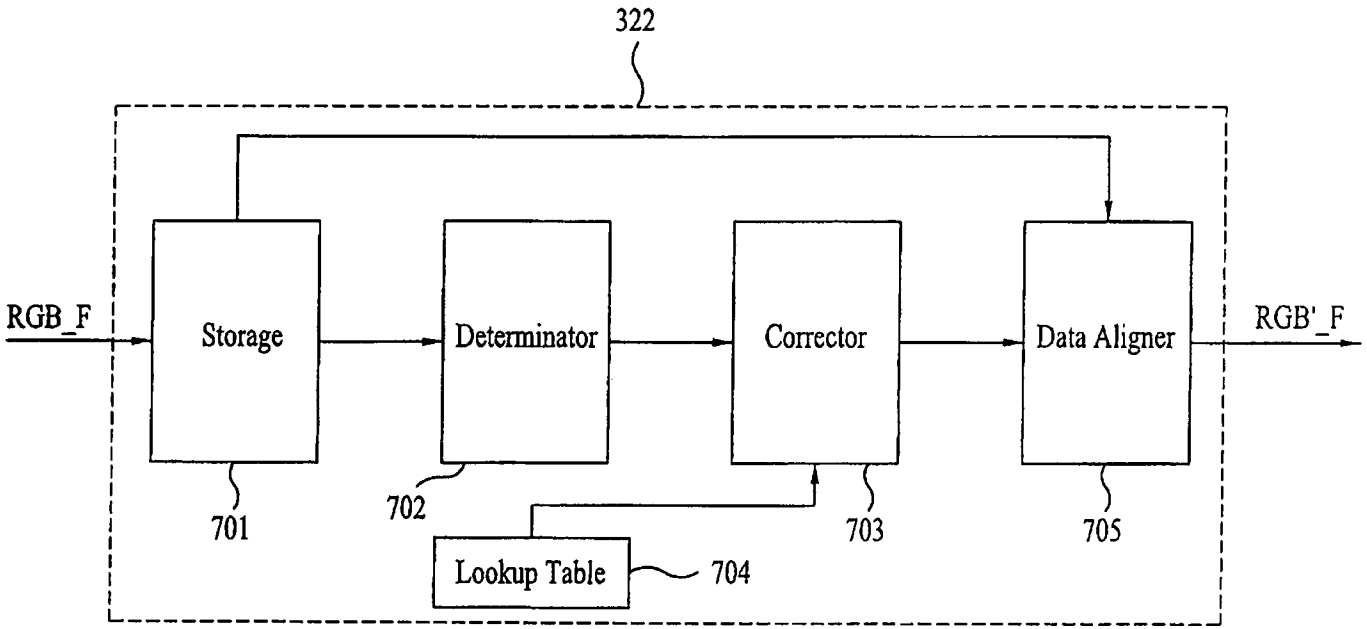
FIG. 7 is a second exemplary block diagram of the data modulator shown in FIG. 3 according to the present invention.

FIG. 7 is a second exemplary block diagram of the data modulator shown in FIG. 3 according to the present invention. As shown in FIG. 7, the data modulator 322 includes a storage 701 for receiving a plurality of positive and negative data signals associated with one frame period from the timing controller 321 and storing the received positive and negative data signals. The data modulator 322 further includes a determinator 702 for determining whether or not the grayscale values of all positive and negative data signals stored in the storage 701 are identical. The data modulator 322 further includes a lookup table 704 stored with respective grayscale values for the positive and negative data signals. The data modulator 322 further includes a corrector 703 for selecting a desired grayscale value from the lookup table 704, based on the result of the determination from the determinator 702, and correcting the grayscale value of one of the positive and negative data signals supplied in two successive periods. The data modulator 322 further includes a data aligner 705 for aligning the corrected data signal from the corrector 703 with the positive and negative data signals from the storage 701 and alternately outputting the aligned positive and negative data signals at intervals of at least two successive periods.

The data modulator 322 having the above-described configuration determines whether or not all data signals displayed for one frame period have the same grayscale value. The data modulator 322 further determines whether or not modulation of the data signals should be executed based on the result of the determination. When all the data signals have the same grayscale value, the data modulator 322 modulates the grayscale value of one of the positive and negative data signals supplied in two successive periods.

Figure 8:
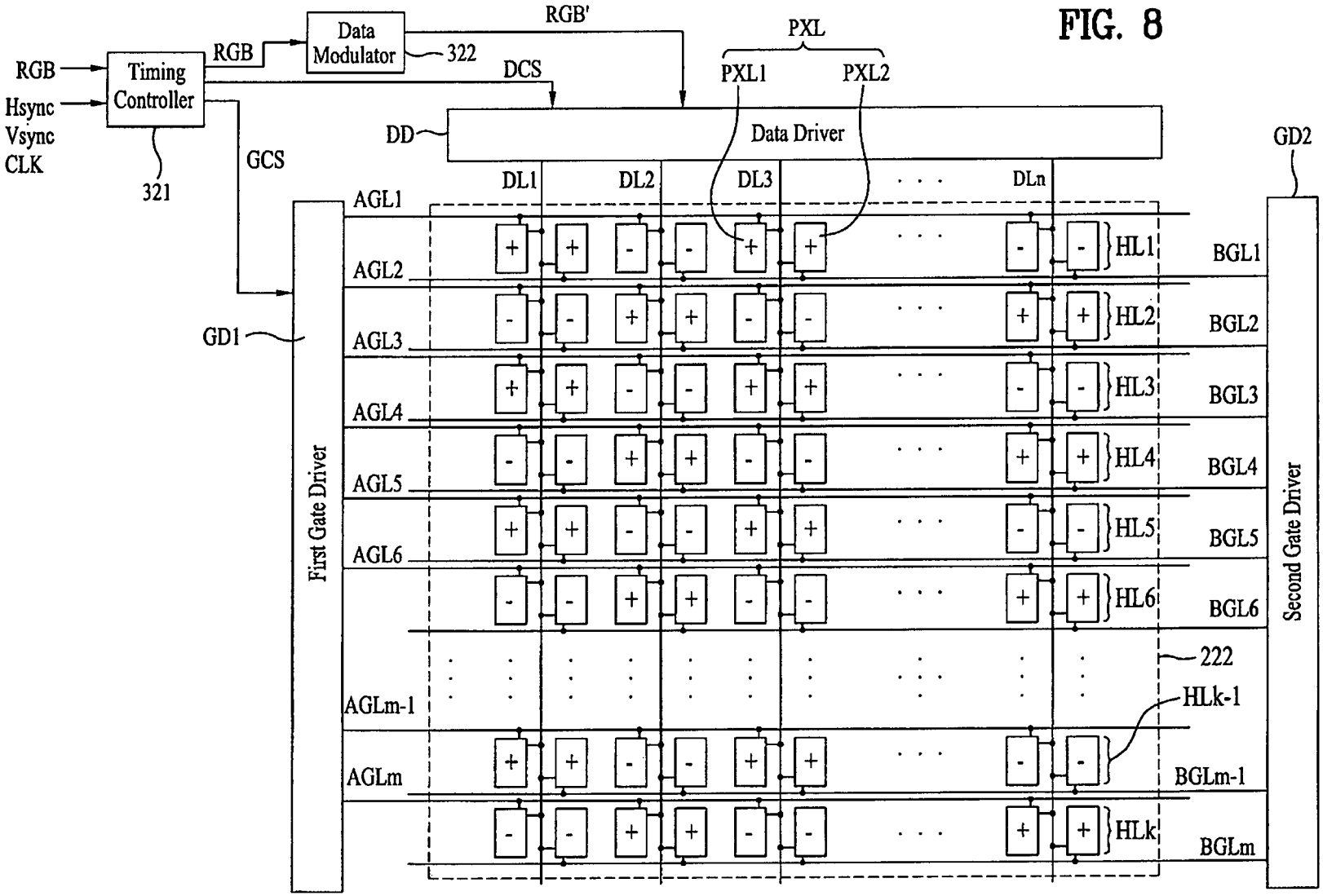
FIG. 8 is a block diagram illustrating an LCD device according to a second exemplary embodiment of the present invention.

FIG. 8 is a block diagram illustrating an LCD device according to a second exemplary embodiment of the present invention. As shown in FIG. 8, the LCD device according to the second embodiment of the present invention includes a liquid crystal panel 222 including a plurality of pixel rows HL1, HL2, HL3, HL4, . . . , HLk (hereinafter, referred to as "HL1 to HLk"), and a plurality of data lines DL1 to DLn arranged to intersect the pixel rows HL1 to HLk. The LCD device includes first pixel cells PXL1 formed on each of the pixel rows HL1 to HLk such that each first pixel cell PXL1 is arranged at and connected to the left side of an associated one of the data lines DL1 to DLn. The LCD device further includes a second pixel cells PXL2 formed on each of the pixel rows HL1 to HLk such that each second pixel cell PXL2 is arranged at and connected to the right side of an associated one of the data lines DL1 to DLn. The LCD device further includes a plurality of A-gate lines AGL1 to AGLm and a plurality of B-gate lines BGL1 to BGLm, which receive scan pulses in different directions, respectively. The LCD device further includes a first gate driver GD1 for driving the A-gate lines AGL1 to AGLm, a second gate driver GD2 for driving the B-gate lines BGL1 to BGLm, a data driver DD for driving the data lines DL1 to DLn, a timing controller 321 for controlling the first and second gate drivers GD1 and GD2 and data driver DD, and a data modulator 322 for modulating data signals supplied from the timing controller 321 and supplying the modulated data signals to the data driver DD.

Each of the A-gate lines AGL1 to AGLm is arranged above an associated one of the pixel rows HL1 to HLk. The A-gate lines AGL1 to AGLm are driven by the first gate driver GD1 arranged at the left side of the liquid crystal panel 222. Each of the B-gate lines BGL1 to BGLm is arranged beneath an associated one of the pixel rows HL1 to HLk. The B-gate lines BGL1 to BGLm are driven by the second gate driver GD2 arranged at the right side of the liquid crystal panel 222.

The first pixel cells PXL1 in each of the pixel rows HL1 to HLk are connected in common to an associated one of the A-gate lines AGL1 to AGLm. The second pixel cells PXL2 in each of the pixel rows HL1 to HLk are connected in common to an associated one of the B-gate lines BGL1 to BGLm.

The A-gate lines AGL1 to AGLm are sequentially driven in the order from the first A-gate line AGL1 to the m-th A-gate line AGLm. The B-gate lines BGL1 to BGLm are sequentially driven in the order from the first B-gate line BGL1 to the m-th B-gate line BGLm. The A-gate lines AGL1 to AGLm and the B-gate lines BGL1 to BGLm are alternately driven. Accordingly, in each pixel row, the first pixel cells PXL1 connected to one of the A-gate lines AGL1 to AGLm first receive data signals, and the second pixel cells PXL2 connected to one of the B-gate lines BGL1 to BGLm receive data signals thereafter.

Positive and negative data signals are alternately supplied to each of the data lines DL1 to DLn at intervals of two successive periods, as described above. In association with one data line, accordingly, the first pixel cell PXL1 connected to the left side of the data line and the second pixel cell PXL2 connected to the right side of the data line receive data signals having the same polarity, respectively. Also, data signals having opposite polarities are supplied to the adjacent data lines, respectively. Accordingly, the pixel cells PXL1 or PXL2 connected to the adjacent data lines receive data signals having opposite polarities, respectively.

The data modulator 322 is identical to the data modulator 322 described in conjunction with the first embodiment. Therefore, the data modulator 322 modulates the grayscale value of one of positive and negative data signals to be respectively supplied to a data line in two successive periods. Accordingly, it is possible to prevent deviation of brightness from occurring between the first and second pixel cells PXL1 and PXL2, which are connected in common to the same data line while being arranged in different pixel rows.

For example, it is possible to prevent deviation of brightness from occurring between the second pixel cell PXL2 arranged in the first pixel row HLK1 and connected to the right side of the first data line DL1 and the first pixel cell PXL1 arranged in the second pixel row HLK2 and connected to the left side of the first data line DL1. That is, the first pixel cell PXL1, which is arranged in the second pixel row HLK2 and connected to the left side of the first data line DL1, receives a modulated data signal.

It will be apparent to those skilled in the art that various modifications and variations can be made in the liquid crystal display device and a method for driving the same of the present invention without departing from the spirit or scope of the invention. Thus, it is intended that the present invention cover the modifications and variations of this invention provided they come within the scope of the appended claims and their equivalents.

What is claimed is:

1. A liquid crystal display device comprising:

at least one data line;

a plurality of first pixel cells connected in common to one side of the data line, and sequentially driven in accordance with gate signals respectively output from first gate lines in every period;

a timing controller for alternately outputting first and second-polarity data signals for display of an image, at intervals of at least two successive periods;

a data modulator for outputting the first and second-polarity data signals supplied from the timing controller, the data modulator modulating a grayscale value of one of the first and second-polarity data signals respectively supplied in two successive periods from the timing controller, and outputting the modulated data signal; and a data driver for receiving the first and second-polarity data signals from the data modulator, and alternately outputting the first and second-polarity data signals at intervals of at least two successive periods, to supply the first and second-polarity data signals to the data line;

wherein the data modulator comprises:

a storage for receiving a plurality of first and second-polarity data signals associated with one frame period from the timing controller, and storing the received first and second-polarity data signals;

a determinator for determining whether or not grayscale values of all first and second-polarity data signals stored in the storage are identical;

a lookup table stored with respective grayscale values for the first and second-polarity data signals;

a corrector for selecting a desired grayscale value from the lookup table, based on a result of the determination from the determinator, and correcting the grayscale value of one of the first and second-polarity data signals respectively supplied in two successive periods when the result of the determination from the determinator indicates that the respective grayscale values for all the first and second-polarity data signals stored in the storage are identical;

a data aligning/outputting unit for aligning the corrected data signal from the corrector with the first and second-polarity data signals from the storage, and alternately outputting the aligned first and second-polarity data signals at intervals of at least two successive periods;

a plurality of second pixel cells connected in common to the other side of the data line and sequentially driven in accordance with gate signals respectively output from second gate lines in every period, wherein the first pixel cells and the second pixel cells are alternately driven; and first and second gate drivers located respectively at first and second sides of the display device, the first and second sides opposite to each other relative to a display area of the display device, the first gate driver configured to drive the first gate lines with the gate signals output from the first gate lines to the plurality of first pixel cells, and the second gate driver configured to drive the second gate lines with the gate signals output from the second gate lines to the plurality of second pixel cells, wherein the first and second gate lines receive scan pulses from opposite directions and are alternately driven by the first and second gate drivers.

2. The liquid crystal display device according to claim 1, wherein:

the at least one data line comprises a plurality of data lines;

the data driver outputs the first and second-polarity data signals to odd numbered data lines at intervals of at least two successive periods to supply the first and second-polarity data signals to each data line; and the data driver outputs, to even numbered data lines, a data signal having a polarity opposite to a polarity of the data signal supplied to the odd data lines.

3. The liquid crystal device according to claim 1, wherein one of the first and second-polarity data signals is a positive data signal, and the other of the first and second-polarity data signals is a negative data signal.

4. The liquid crystal device according to claim 1, wherein the data modulator modulates the grayscale value of the one of the first and second-polarity data signals respectively supplied in the two successive periods to a level higher or lower than an original grayscale value by 1 to 10 levels.

5. A method for driving a liquid crystal display device including at least one data line, a plurality of first pixel cells connected in common to one side of the data line, and sequentially driven in accordance with gate signals respectively output from first gate lines in every period, and a plurality of second pixel cells connected in common to the other side of the data line and sequentially driven in accordance with gate signals respectively output from second gate lines in every period, wherein the first pixel cells and the second pixel cells are alternately driven, and a timing controller for alternately outputting first and second-polarity data signals for display of an image, at intervals of at least two successive periods, comprising:

modulating a grayscale value of one of the first and second-polarity data signals respectively supplied in two successive periods from the timing controller, for all the first and second-polarity data signals supplied from the time controller; and alternately outputting the resultant first and second-polarity data signals at intervals of at least two successive periods, to supply the first and second-polarity data signals to the data line;

wherein the step of modulating the data signals comprises:

receiving a plurality of first and second-polarity data signals associated with one frame period from the timing controller, and storing the received first and second-polarity data signals;

determining whether or not grayscale values of all the stored first and second-polarity data signals are identical;

selecting a desired grayscale value from a lookup table, based on a result of the determination, and correcting the grayscale value of one of the first and second-polarity data signals respectively supplied in two successive periods when the result of the determination indicates that the grayscale values of all the stored first and second-polarity data signals are identical; and aligning the corrected data signal with the stored first and second-polarity data signals, and alternately outputting the aligned first and second-polarity data signals at intervals of at least two successive periods;

driving the first gate lines with gate signals output from a first gate driver located at a first side of the display device;

driving the second gate lines with gate signals output from a second gate driver located at a second side of the display device, the first and second sides being opposite to each other relative to a display area of the display device, the first and second gate lines receiving scan pulses from opposite directions and being alternately driven by the first and second gate drivers.

6. The liquid crystal device according to claim 5, wherein the grayscale value of the one of the first and second-polarity data signals is modulated to a level higher or lower than an original grayscale value by 1 to 10 levels.

* * * * *